US010239031B2

(12) United States Patent
Taddei et al.

(10) Patent No.: US 10,239,031 B2
(45) Date of Patent: Mar. 26, 2019

(54) APPARATUS AND METHOD FOR MIXING FLUIDS WITH DEGRADATIONAL PROPERTIES

(71) Applicant: VEECO PRECISION SURFACE PROCESSING LLC, Horsham, PA (US)

(72) Inventors: John Taddei, Jim Thorpe, PA (US); John Clark, Philadelphia, PA (US); Mark Yannuzzi, Horsham, PA (US); Laura Mauer, South Kent, CT (US); Paul Vit, Horsham, PA (US)

(73) Assignee: VEECO PRECISION SURFACE PROCESSING LLC, Horsham, PA (US)

( * ) Notice: Subject to any disclaimer, the term of this patent is extended or adjusted under 35 U.S.C. 154(b) by 232 days.

(21) Appl. No.: 15/081,105

(22) Filed: Mar. 25, 2016

(65) Prior Publication Data

US 2016/0288070 A1 Oct. 6, 2016

Related U.S. Application Data

(60) Provisional application No. 62/141,632, filed on Apr. 1, 2015.

(51) Int. Cl.

| | |
|---|---|
| ***B01F 15/00*** | (2006.01) |
| ***B01F 3/20*** | (2006.01) |
| ***B01F 15/04*** | (2006.01) |
| ***B01F 3/08*** | (2006.01) |

(52) U.S. Cl.

CPC ..... *B01F 15/0022* (2013.01); *B01F 3/088* (2013.01); *B01F 3/0865* (2013.01); *B01F 3/2078* (2013.01); *B01F 15/00175* (2013.01); *B01F 15/00344* (2013.01); *B01F 15/00993* (2013.01); *B01F 15/0429* (2013.01)

(58) Field of Classification Search

CPC ..... B01F 15/0022; B01F 15/00175; B01F 15/00344; B01F 15/00993; B01F 15/0429; B01F 3/0865; B01F 3/088; B01F 3/2075

See application file for complete search history.

(56) References Cited

U.S. PATENT DOCUMENTS

| | | | | |
|---|---|---|---|---|
| 3,223,121 | A | 12/1965 | Lee et al. | |
| 4,442,720 | A | 4/1984 | Apley et al. | |
| 5,231,865 | A | 8/1993 | McDermott et al. | |
| 5,283,001 | A * | 2/1994 | Gregoli | B01F 3/0807 137/13 |
| 6,150,177 | A | 11/2000 | Stock | |
| 6,239,038 | B1 | 5/2001 | Wen | |
| 6,394,110 | B2 | 5/2002 | Kamikawa et al. | |
| 6,584,989 | B2 | 7/2003 | Taft et al. | |

(Continued)

FOREIGN PATENT DOCUMENTS

| | | |
|---|---|---|
| WO | WO 2009/064878 | 5/2009 |
| WO | WO 2009/069090 | 6/2009 |

*Primary Examiner* — Queenie S Dehghan
(74) *Attorney, Agent, or Firm* — Leason Ellis LLP

(57) ABSTRACT

An apparatus and method for mixing fluids with degradational properties are disclosed herein. The present system has been devised to safely and accurately dilute, heat and deliver a degradable fluid while simultaneously removing extraneous vapor, adding capability to monitor the temperature and capability to monitor the concentration of the diluted fluid.

18 Claims, 2 Drawing Sheets

(56) References Cited

U.S. PATENT DOCUMENTS

Figure 1:
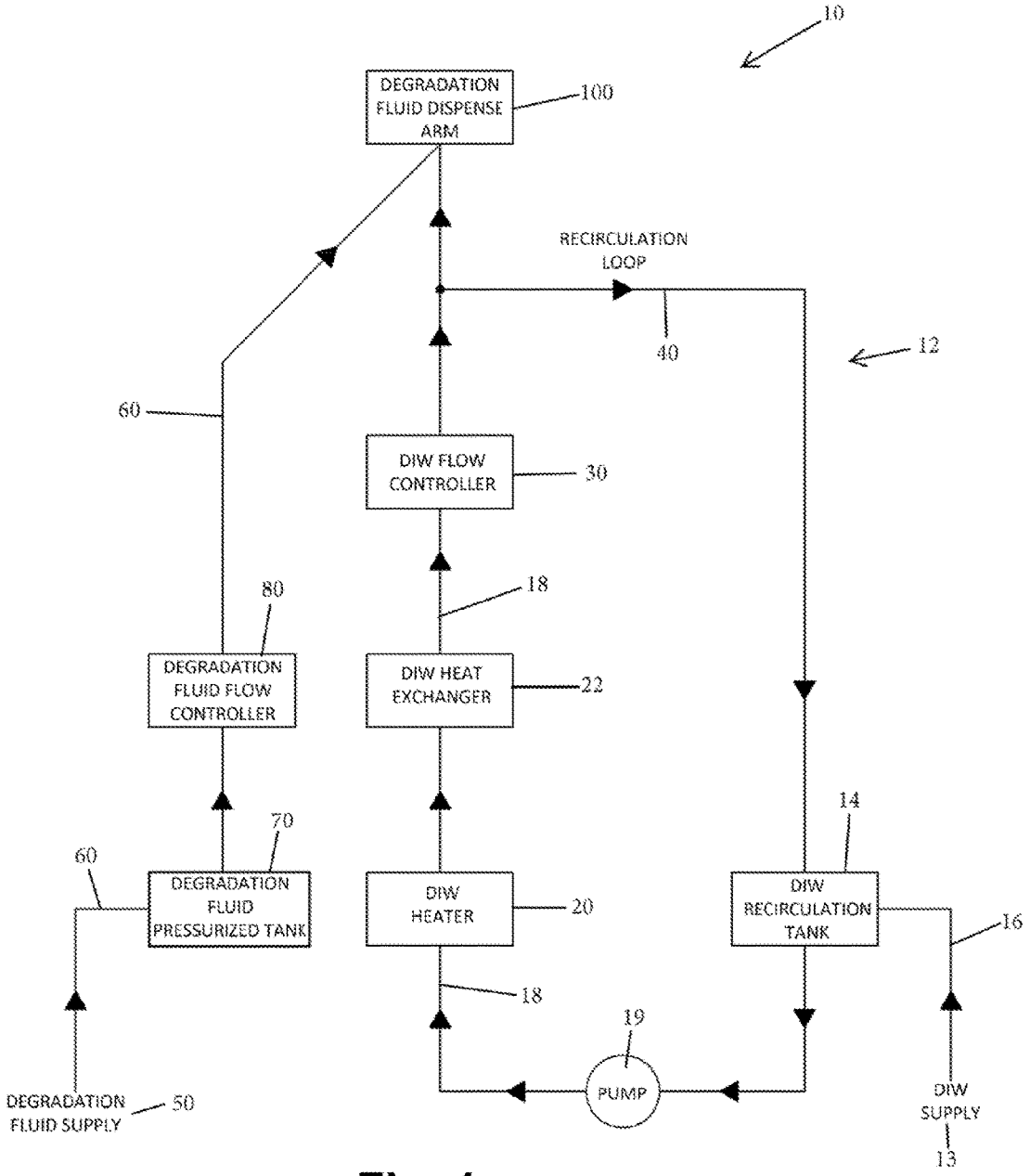

| | | | | |
|---|---|---|---|---|
| 7,195,747 | B2 | 3/2007 | Vanden Bussche et al. | |
| 2002/0154567 | A1* | 10/2002 | Husher | B01F 3/088 366/132 |
| 2003/0174306 | A1 | 9/2003 | Grant et al. | |
| 2004/0100860 | A1 | 5/2004 | Wilmer et al. | |
| 2009/0087921 | A1 | 4/2009 | Hill | |
| 2013/0270478 | A1 | 10/2013 | Wood et al. | |
| 2016/0279594 | A1* | 9/2016 | Choi | B01J 19/24 |

* cited by examiner

DEGRADATION FLUID MIXING SYSTEM

APPARATUS AND METHOD FOR MIXING FLUIDS WITH DEGRADATIONAL PROPERTIES

CROSS-REFERNECE TO RELATED APPLICATION

This application is based on and claims priority to U.S. Provisional Patent Application 62/141,632, filed Apr. 1, 2015, the entire contents of which is incorporated by reference herein as if expressly set forth in its respective entirety herein.

TECHNICAL FIELD

The present invention in general relates to an apparatus and method for preparing fluids for industrial processes. More specifically, the invention provides the capability to accurately and safely heat and dilute a process chemistry, while eliminating several issues inherent to the physical properties of the fluid and adding control feedback of multiple process variables as an option to the sequence.

BACKGROUND

Historically hydrogen dioxide (30%) has been used to etch titanium tungsten (TiW). The etchant has been employed because of its selectivity to other materials and its less corrosive nature than alternative etchants. The etch rate is slow, so the fluid is typically heated to 40° C. to increase the etch rate. Although the process results can be excellent, the heated hydrogen dioxide presents a number of process and safety hurdles to overcome.

Hydrogen dioxide degrades naturally and this degradation is accelerated with an increase in temperature. The degradation is the molecule splitting into water and oxygen gas. When this occurs inside vessels or other plumbing, vapor pockets form within the liquid. Liquid dispenses will then be partially liquid and partially vapor and this can greatly affect process results. It takes some time to heat and stabilize the etchant loop so during standby condition a process tool needs to maintain the fluid in circulation and at temperature. This rapidly degrades the chemistry in the standby mode, even with no production occurring. The slow etch rate (even if heated) means the processes are fairly long in duration. Accordingly the chemistry needs to be recycled to make the process economical. The material to be etched normally coincides with a range of materials. Some of these could be transitional metals or other material that will greatly increase the degradation rate of hydrogen dioxide. This can lead to safety issues where the liquid will rapidly decompose and over pressurize plumbing components to an unsafe condition.

BRIEF DESCRIPTION OF THE DRAWING FIGURES

Figure 2:
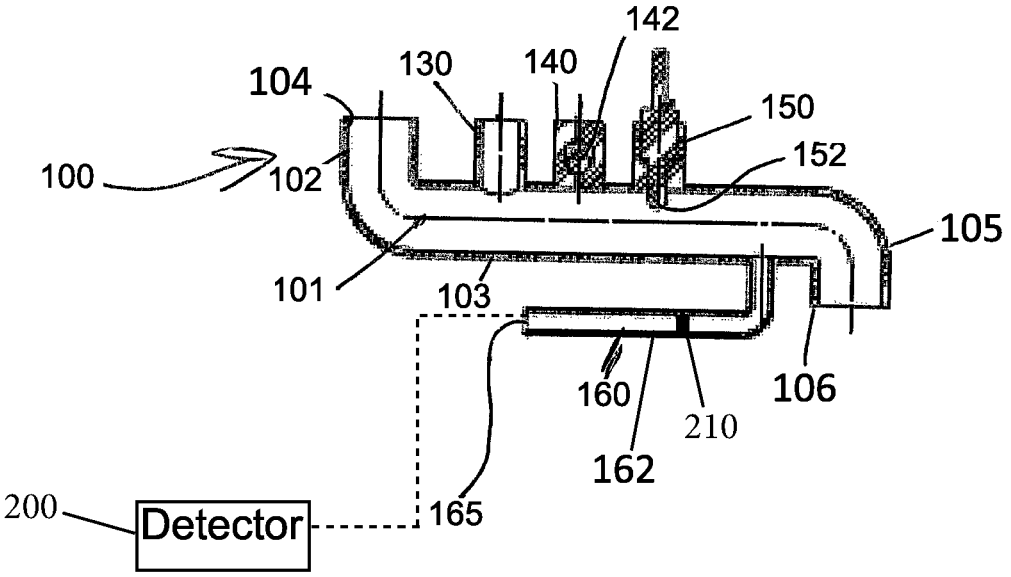

FIG. 1 is a schematic of an exemplary degradation mixing system including a heated deionized water (DI) loop; and FIG. 2 is a cross-sectional view of a mixing arm that is part of the degradation mixing system of FIG. 1.

DETAILED DESCRIPTION OF CERTAIN EMBODIMENTS

The present invention in general relates to an apparatus and method for preparing fluids for industrial processes.

More specifically the present invention provides the capability to accurately and safely heat and dilute a process chemistry, while eliminating several issues inherent to the physical properties of the fluid and adding control feedback of multiple process variables as an option to the sequence.

As shown in FIG. 1, the present invention is implemented in an alternately laid out plumbing path that includes a mixing arm 100 yields a number of economic, safety and process control enhancements to the process.

As shown in FIG. 1, one exemplary degradation mixing system 10 includes a heated deionized water (DI) loop generally indicated at 12. The loop 12 includes a source of deionized water (DI) or other similar fluid 13 and is fluid connected to a recirculation vessel (tank) 14 by a first conduit 16. A pump 19 is provided along a second conduit 18 that extends between the recirculation vessel 14 and the mixing arm 100. The pump 19 is configured to pump the DI water along the second conduit 18. In addition, the second conduit 18 defines a heated fluid circuit in that the second conduit 18 a heater 20 and a heat exchanger 22. As shown, the heat exchanger 22 is downstream of the heater 20. A flow controller 30 is located along the second conduit 18 downstream of the heat exchanger 22. The flow controller 30 can be any number of different types of flow control devices that serve to control the flow (flow rate) of the DI water in the second conduit 18.

The DI circuit also includes a recirculation loop defined by a third conduit 40. The third conduit 40 extends from a point along the second conduit 18 downstream of the flow controller 30 to the recirculation vessel 14.

In addition, the system 10 also includes a source of degradation fluid 50. A fourth conduit 60 extends between the degradation fluid 50 to the mixing arm 100. Along the fourth conduit 60, a degradation fluid pressurized vessel (tank) 70 is provided. Downstream of the vessel 70, a degradation fluid flow controller 80 is provided to control flow (flow rate) of the degradation fluid in the fourth conduit 60 in the direction of the mixing arm 100.

The heated plumbing path consists of a heated deionized water (DI) loop with a set point of 85° C. and temperature control to 0.1° C. With only the DI heated in a standby state, the hydrogen dioxide degradation is greatly reduced. The degradation rate is reduced to what it would be in storage, instead of the chemical batch needing to be replaced after a few hours at elevated temperature.

The heated DI is passed through a flow controller to deliver a precise volume of heated water. During standby this is recycled back to the heater loop and during processing is delivered to the mixing arm 100.

The mixing arm 100 is a multi-conduit structure as shown in FIG. 2. More specifically, the mixing arm 100 is a hollow arm structure with a number of side ports/conduits. The mixing arm 100 has an open first end 104 and an open second end 106. The mixing arm 100 can be in the form of a tubular structure formed of a suitable material. The mixing arm 100 includes a main conduit 101 that extends from the first end 104 to the second end 106. This main conduit 101 defines a main fluid flow path. As described herein, the first end 104 can be thought of as being an inlet (entrance) and the second end 106 can be thought of as being an outlet (exit). As shown, the mixing arm 100 and main conduit 101 can have a non-linear construction. As shown, the mixing arm 100 can have a first bent section 102, a linear center portion 103, and a second bent section 105. The first bent section 102 defines and terminates at the first end 104 and the second bent section 105 defines and terminates at the second end 106. The first bent section 102 can be bent in a first direction and the second bent section 105 can be bent in a second direction which can be opposite to the first direction. A central axis passing through each of the first and second bent sections 102, 105 can be perpendicular to a longitudinal axis of the linear center portion 103.

The entrance at the first end 102 defines a first station/first position in the mixing arm 100 which receives the heated DI water from the second conduit 18 of the DI loop 12 (circuit) or from some other location in alternative embodiments. Since there is a flow control device 30 (e.g., valve device) along the flow path 18 of the heated DI water, the flow of heated DI water can be controlled to regulate the flow of heated DI water into the mixing arm 100 (at the inlet).

The mixing arm 100 has a first side port 130 that is in fluid communication with the main conduit 101. The first side port 130 can be in the form of tubular structure that extends outwardly from the linear center portion 103. In one exemplary operating mode, the first side port is fluidly connected to the source 50 of ambient temperature hydrogen dioxide (degradation fluid). More specifically, the conduit 60 can be connected to the first side port 130 to deliver the degradation fluid (hydrogen dioxide) to the mixing arm 100. Flow control device 80 (e.g., a valve device) is also provided along the flow path of the ambient temperature hydrogen dioxide to allow the flow thereof to be regulated. This allows a selected flow of ambient temperature hydrogen dioxide through the first side port 130 into the main conduit 101. The flow of ambient temperature hydrogen dioxide into the main conduit 101 along with the heated DI thus forms a mixture in the main conduit 101.

Since the flow of heated DI water is regulated by one flow control device 30 and the flow of ambient temperature hydrogen dioxide is regulated by another flow control device 80, an accurate concentration of diluted chemistry can be provided. Because the hot DI is held at a very stable temperature and the mix ratio is stable at 1:6 (chemistry:hot DI), the resulting mixture is at a known, stable temperature. This mixture flows toward the open second end (outlet) 104 of the mixing arm 100.

The mixing arm 100 is constructed to include a second side port 140 that is in fluid communication with the main conduit 101. The second side port 140 can be in the form of tubular structure that extends outwardly from the linear center portion 103. This second side port 140 contains a mechanism 142 to remove any excess vapors that may have formed in the mixture. Any number of different mechanisms 142, including vent mechanisms 142, can be used to allow discharge of vapors from the mixture as it flows within the main conduit 101 toward the outlet 104. The second side port 140 is thus downstream of the first side port 130 and the inlet 104.

The mixing arm 100 is constructed to include a third side port 150 that is in fluid communication with the main conduit 101. The third side port 150 can be in the form of tubular structure that extends outwardly from the linear center portion 103 and is located downstream of the second side port 140. The third side port 150 contains a thermocouple 152 (temperature sensor). This thermocouple 152 accurately monitors the temperature of the mixture just prior to it is dispensed through the outlet 106. This monitoring (measuring) is valuable in documenting process conditions as etch rate varies by ten percent per degree C.

As shown in FIG. 2, the thermocouple 152 is disposed within the hollow interior of the third side port 150 with at least a portion (the sampling portion) of the thermocouple 152 being disposed at least partially within the main conduit 101 so as to be in contact with the fluid flowing within the main conduit 101. However, the thermocouple 152 does not interfere with the flow of the fluid within the main conduit 101.

While the first, second and third side ports 120, 130, 140 are shown as having identical or similar outer diameters, this is merely for illustrated and it will be appreciated that the sizes of the first, second and third side ports 120, 130, 140 can be different and as shown in FIG. 2, the inner constructions (flow paths) of each differ from one another based on their different intended operations (functions).

The mixing arm 100 also includes a sample port 160 that is in the form of a conduit that extends outwardly from the linear center portion 103. The sample port 160 can be in the form of an elongated leg that extends outwardly from the linear center portion 103 downstream of the third side port 150 but prior to the outlet 106. The sample port 160 can have a shape different than the side ports and/or the location of the sample port 160 can be different than the side ports. For example, in the illustrated embodiment, the sample port 160 is formed on the linear center portion 103 opposite the side ports. Also, the sample port 160 can have a smaller diameter compared to the side ports and has a longer length. As illustrated, the sample port 160 can have a main section 162 that has a longitudinal axis that is parallel to the longitudinal axis of the main conduit 101. The sample port 160 terminates in an open end 165 which serves as an outlet through which a sample can pass. It will be appreciated that the sample port 160 can be fluidly connected to another structure, such as a fluid conduit that delivers the sample to another location (sampling location). A flow controller 210 can be disposed along the flow path of the sample to allow for selective sampling thereof. For example, a valve member 210 can be provided and a prescribed amount of fluid can be sampled by opening up the valve member.

In one embodiment the sample port 160 is used to divert a small volume of the heated process fluid to a concentration monitor 200 that is at the sampling location. The concentration of the mixture to be dispensed through the outlet 106 can be measured for purposes of process control. Although the chemistry is single pass, the fluid mixture can be dispensed at 75° C. and at ⅙ the original concentration. The higher temperature more than offsets the lower concentration in terms of etch rate. In practice, an etch rate of more than 3× is observed with the diluted chemistry. In this manner, the fluid is single pass but due to higher etch rate and no chemistry losses during standby mode, the chemistry used can be less than when full concentration chemistry is used and recycled. Finally since the chemistry is not recycled, contaminants do not build up in the recycle loop. This eliminates the potential for contaminant related accelerated degradation and greatly improves the overall safety of the operation.

The present invention can thus include one or more of the following features:

1—Immediately prior to dispense the mixing arm will remove excessive vapor that would degrade process results.

2—Immediately prior to dispense the mixing arm provides the capability to monitor the chemistry temperature for accurate process monitoring.

3—Immediately prior to dispense the mixing arm provides the capability to withdraw a fluid sample for purposes of concentration measurement.

4—The mixing arm is unique in having undesired vapor elimination, temperature monitoring and concentration monitoring capability for a heated, diluted degradation fluid mixing and delivery system.

5—point 4 highlights the process controls required to eliminate heating of hydrogen dioxide.

6—point 4 highlights the process controls required to eliminate the recirculation of hydrogen dioxide.

7—points 4,5 and 6 combine the process controls and conditions to eliminate accelerated degradation safety issues associated with heated and recycled hydrogen dioxide.

What is claimed is:

1. A degradation mixing system comprising:

a first fluid loop including a source of a first fluid and a heater disposed within the first fluid loop for heating the first fluid and a first flow controller for controlling a flow rate of the heated first fluid;

a source of ambient temperature degradation fluid;

a tubular mixing arm having a hollow body with an inlet at a first open end of the tubular mixing arm for receiving the heated first fluid and an outlet at an opposing second open end of the tubular mixing arm, wherein the mixing arm includes a first port downstream of the inlet for receiving the degradation fluid and permit mixing of the first fluid and the degradation fluid to form a first mixture, wherein the mixing arm includes a vent downstream of the first port for removal of vapor from the first mixture;

a temperature sensor for monitoring a temperature of the first mixture after the vent but prior to the first mixture being dispensed through the outlet;

a sampling conduit that is integral to the mixing arm and in fluid communication with an interior of the hollow body to allow a quantity of the first mixture to be sampled and removed from the hollow body prior to the first mixture being dispensed through the outlet; and a detector in fluid communication with the sampling conduit for measuring a concentration of the first mixture;

wherein the first flow controller is configured to deliver a precise volume of the first fluid to the tubular mixing arm.

2. The system of claim 1, further including a source of the first fluid which comprises deionized water.

3. The system of claim 1, further including a source of the degradation fluid which comprises hydrogen dioxide.

4. The system of claim 1, wherein the inlet is located at a first end of the hollow body and the outlet is located at a second end of the hollow body.

5. The system of claim 1, wherein the temperature sensor is disposed downstream of a second port that is in fluid communication with the vent.

6. The system of claim 5, wherein the sampling conduit is disposed between the temperature sensor and the outlet.

7. The system of claim 1, wherein the temperature sensor comprises a thermocouple.

8. The system of claim 7, wherein the thermocouple is disposed within a third port and has a portion that is disposed within the hollow body in fluid communication with the first mixture for sensing the temperature thereof.

9. The system of claim 1, wherein the sampling conduit comprises a tube that extends outwardly from the hollow body for monitoring a concentration of the first mixture.

10. The system of claim 1, wherein the hollow body comprises a first bent portion that terminates in the inlet, a central linear portion and a second bent portion that terminates in the outlet.

11. The system of claim 10, wherein the first port, a second port that is in fluid communication with the vent and the temperature sensor are disposed in the central linear portion.

12. The system of claim 1, wherein the first fluid is heated along a first conduit that delivers the first fluid from the source of the first fluid to the inlet, the first conduit further including a first flow controller for controlling a flow rate of the first fluid into the mixing arm.

13. The system of claim 12, further including a recirculation loop for recirculating the heated first fluid.

14. The system of claim 1, wherein the degradation fluid flows in a second conduit to the first port, the second conduit including a second flow controller for controlling a flow rate of the degradation fluid into the first port.

15. The system of claim 1, wherein the mixing arm and sampling conduit are formed as a single integral part.

16. The system of claim 1, wherein the heater is controlled so as to maintain the first fluid at a stable temperature and a second flow controller is configured to deliver a precise volume of the degradation fluid to the tubular mixing arm and the first flow controller and the second flow controller are configured to maintain a mix ratio of the degradation fluid: first fluid at 1:6, thereby producing the resulting first mixture at a known, stable temperature.

17. A degradation mixing system comprising:

a first fluid loop including a source of a first fluid and a heater disposed within the first fluid loop for heating the first fluid and a first flow controller for controlling a flow rate of the heated first fluid;

a source of ambient temperature degradation fluid;

a tubular mixing arm having a hollow body that defines a main flowpath and includes an inlet for receiving the heated first fluid and an outlet, wherein the mixing arm includes a first port downstream of the inlet for receiving the degradation fluid and permit mixing of the first fluid and the degradation fluid to form a first mixture, wherein the mixing arm includes a vent downstream of the first port for removal of vapor from the first mixture;

a temperature sensor for monitoring a temperature of the first mixture after the vent but prior to the first mixture being dispensed through the outlet;

a sampling conduit that is integral to the mixing arm and comprises a hollow structure that is in fluid communication with an interior of the hollow body and defines a secondary flowpath to allow a quantity of the first mixture to be sampled from the hollow body by being withdrawn from the main flowpath at a location prior to the first mixture being dispensed through the outlet, wherein a second flow controller is disposed within the sampling conduit for controlling flow along the secondary flowpath; and a detector spaced from the tubular mixing arm and in fluid communication with the sampling conduit for measuring a concentration of the first mixture;

wherein the first flow controller is configured to deliver a precise volume of the first fluid to the tubular mixing arm.

18. The system of claim 17, wherein the tubular mixing arm comprises a main body formed as a single structure and the first port and a second port are integrally formed therewith and protrude outwardly from the main body for providing connection to the main body and sampling conduit is located proximate to the outlet, wherein the second port is in fluid communication with the vent.

* * * * *